US006152097A

United States Patent [19]

Sputhe

[11] Patent Number: 6,152,097

[45] Date of Patent: Nov. 28, 2000

[54] ENGINE BRACE

[76] Inventor: Alan C. Sputhe, 11185 Lime Kiln Rd., Grass Valley, Calif. 95949

[21] Appl. No.: 09/246,250

[22] Filed: Feb. 8, 1999

Related U.S. Application Data

[60] Provisional application No. 60/074,395, Feb. 11, 1998.

[51] Int. Cl.[7] ..... F02F 7/00

[52] U.S. Cl. ..... 123/195 R

[58] Field of Search ..... 123/195 R, 195 A, 123/90.61, 90.67

[56] References Cited

U.S. PATENT DOCUMENTS

| | | | |
|---|---|---|---|
| 1,193,899 | 8/1916 | Jacobs et al. | 123/90.61 |
| 1,721,341 | 7/1929 | Halford | 123/90.61 |
| 1,741,678 | 12/1929 | Brewer | 123/90.61 |
| 2,346,737 | 4/1944 | Essl | 123/90.61 |
| 2,515,347 | 7/1950 | Jameson | 123/90.61 |
| 2,963,012 | 12/1960 | Kolbe | 123/90.61 |
| 3,038,459 | 6/1962 | Schmid | 123/90.61 |

*Primary Examiner*—Marguerite McMahon
*Assistant Examiner*—Jason Benton
*Attorney, Agent, or Firm*—David Weiss

[57] ABSTRACT

Engine brace apparatus for an overhead-valve engine comprising a crankcase, a cylinder, a cylinder head and a rocker arm box in operative securement, with pushrods communicating between the crankcase and the rocker arm box, and a rigid elongate member securing the rocker arm box to the crankcase outwardly of the pushrods. The brace adds rigidity to a conventional overhead-valve engine and structurally ties together the engine's rocker arm box, cylinder head, cylinder and crankcase, and prevents the engine's pushrods from lifting the rocker arm box.

9 Claims, 4 Drawing Sheets

ENGINE BRACE

CROSS REFERENCE TO RELATED APPLICATION

This application claims the benefit of U.S. Provisional Application No. 60/074,395, filed Feb. 11, 1998, which application is incorporated herein by reference.

FIELD OF THE INVENTION

This invention relates to overhead-valve internal combustion engines for motorcycles or aircraft, and more particularly to an engine brace for such engines.

BACKGROUND OF THE INVENTION

A conventional overhead-valve internal combustion engine for a motorcycle or an aircraft includes a crankcase and at least one cylinder, cylinder head and rocker arm box. The cylinder is typically secured to the crankcase by studs or bolts extending through a flange at the base of the cylinder and threaded into the crankcase, while the cylinder head may be separately bolted to the cylinder, or the studs or bolts may be threaded into the crankcase and extend through both cylinder and head.

As is well known, the engine's camshafts are conventionally located in the crankcase, and some form of cam follower imparts motion to pushrods and thence to rocker arms in a rocker arm box located above the head. The pushrods are generally situated outwardly of the cylinder and typically farther beyond the cylinder than the conventional securing studs or bolts, and may extend from a tappet or lifter block secured to the crankcase. When the pushrods are moved by operation of the cam in the crankcase, a force is applied to the rocker arm sufficient to overcome the inertia of the valve, rocker arm, valve collar and keeper as well as to compress the valve spring. The effect is that the force generated tries to lift the rocker arm and box away from the head. The cylinder and head bolts, particularly on the pushrod side of the cylinder head, must resist these forces as well as the combustion pressure within the cylinder.

SUMMARY OF THE INVENTION

By the present invention, an engine brace device provides additional securing structure between the rocker arm box and the crankcase, outwardly or outboard of the pushrods, for assuming some of the forces generated by the valve mechanism. The invention comprises, in an overhead-valve engine, the combination of: a crankcase, a cylinder, a cylinder head and a rocker arm box in operative securement; pushrods communicating with the crankcase and the rocker arm box; and a rigid member, preferably elongate, securing the rocker arm box to the crankcase outwardly of the pushrods.

In one preferred embodiment, one end of the rigid member is secured to the rocker arm box and the other end is secured directly to the crankcase; in another preferred embodiment, the apparatus includes a lifter block operationally secured to the crankcase, with the pushrods extending between the lifter block and the rocker arm box, and the other end of the rigid member is secured to the lifter block; and in a third preferred embodiment, the apparatus further includes a cam cover secured to the crankcase, and the other end of the rigid member is secured to the cam cover.

In accordance with the preferred embodiments, a boss may be provided on the rocker arm box extending outwardly of the pushrods and including an aperture therein; and a rigid elongate member, such as a bolt or stud having a headed first end and a threaded second end, extends through the aperture in the boss with its headed end held by the boss and the member securing the rocker arm to the crankcase outwardly of the pushrods. The threaded end of the elongate member may be threadedly secured directly to the crankcase, to the lifter box secured to the crankcase, or to the cam cover secured to the crankcase.

The engine brace of the present invention adds rigidity to an overhead-valve engine, structurally tying together the engine's rocker arm box, cylinder head, cylinder and crankcase and preventing the engine's pushrods from lifting the rocker arm box.

BRIEF DESCRIPTION OF THE DRAWINGS

The novel features which are believed to be characteristic of the invention, together with further advantages thereof, will be better understood from the following description considered in connection with the accompanying drawings in which preferred embodiments are illustrated by way of examples. It is to be expressly understood, however, that the drawings are for the purpose of illustration and description only, and are not intended as a definition of the limits of the invention.

DESCRIPTION OF THE PREFERRED EMBODIMENTS

Figure 1:
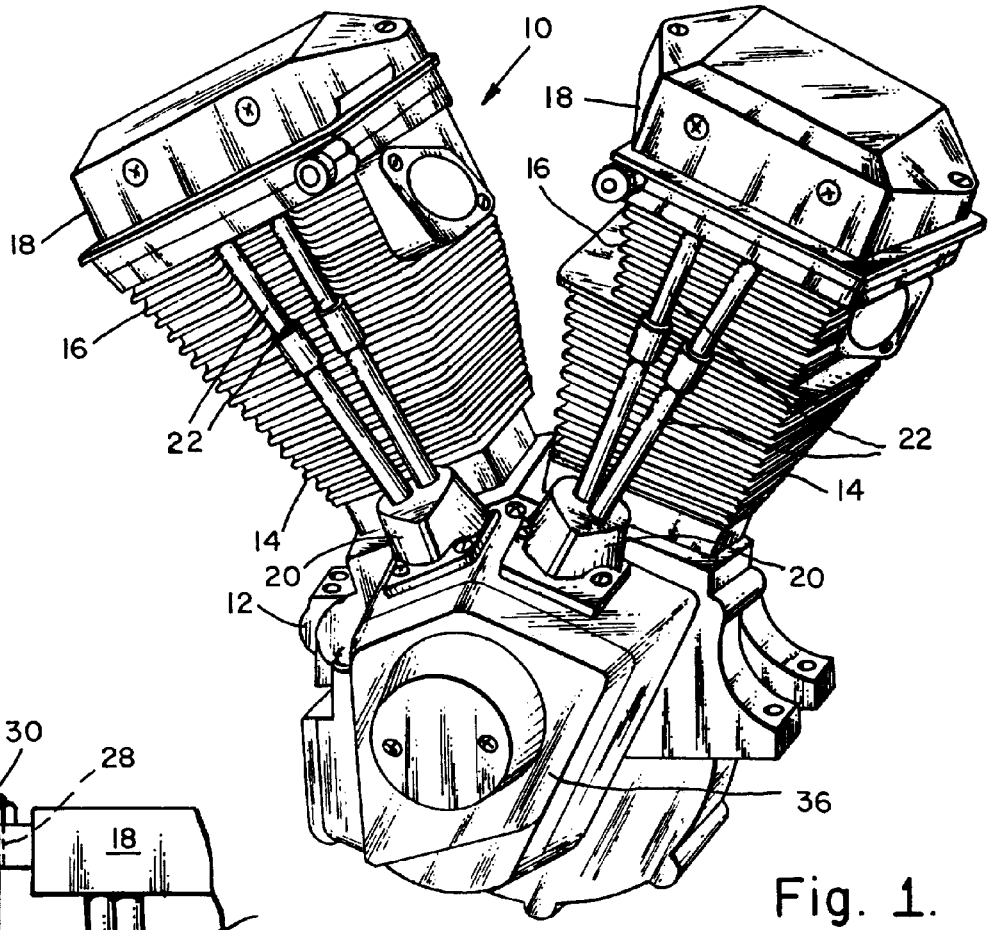
Fig. 1. (PRIOR ART)
FIG. 1 is a perspective view of a conventional overhead-valve internal combustion engine for a motorcycle.

Turning to FIG. 1, an example of a conventional overhead-valve engine for a motorcycle, and in particular a Harley-Davidson motorcycle, includes a crankcase 12 and at least one cylinder 14, cylinder head 16 and rocker arm box 18. The cylinder 14 is typically secured to the crankcase 12 by studs or bolts extending through a flange at the base of the cylinder 14 and threaded into the crankcase 12 while the cylinder head 16 may be separately bolted to the cylinder 14, or the studs or bolts may be threaded into the crankcase 12 and extend through both cylinder 14 and head 16. Examples of such securements are disclosed in U.S. Pat. No. 4,836,158 to Ignatius J. Panzica, and in U.S. Pat. No. 5,072,697 to Alan C. Sputhe, and the disclosures of each of these patents are incorporated herein by reference. The rocker arm box 18 is operatively secured to the cylinder head 16 by conventional means as is well known in the art.

In conventional overhead-valve engines, as is well known, the engine's cam shafts are located in the crankcase 12 and cam followers impart motion to pushrods and thence to rocker arms situated in the rocker arm box 18 located above the cylinder head 16. The pushrods are enclosed in pushrod tubes 22, and a tappet or lifter block 20 may be operatively secured to the crankcase 12 with the protected pushrods extending from the lifter block 20 to the rocker arms in the rocker arm box 18. The pushrods within the pushrod tubes 22 are generally situated outwardly of the cylinder 14 and typically farther beyond the cylinder 14 than the conventional securing studs or bolts. As noted earlier, when the pushrods are moved by operation of the cam in the crankcase 12, forces applied to the rocker arm try to lift the rocker arm box 18 away from the cylinder head 16. The engine brace of the present invention, illustrated in three embodiments in FIGS. 2–5, provides additional securing structure between the rocker arm box 18 and the crankcase 12, outwardly or outboard of the pushrods, for assuming some of these forces and for relieving the conventional studs of some of these forces.

Figure 3:
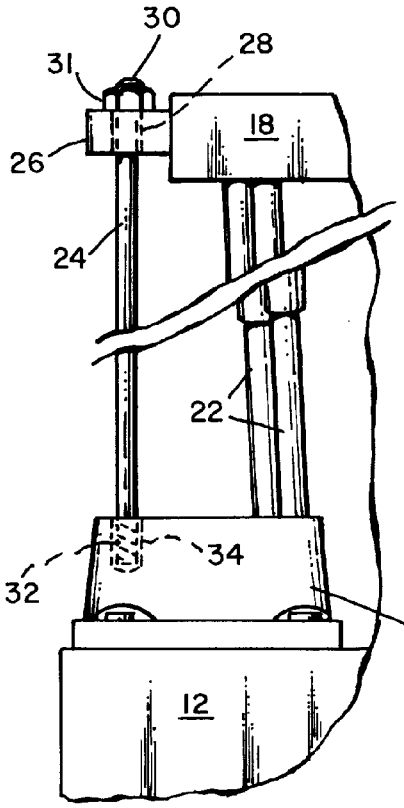
FIG. 3 is a fragmentary elevation of the apparatus of FIG. 2, illustrating the engine brace's securement to the engine.
Figure 2:
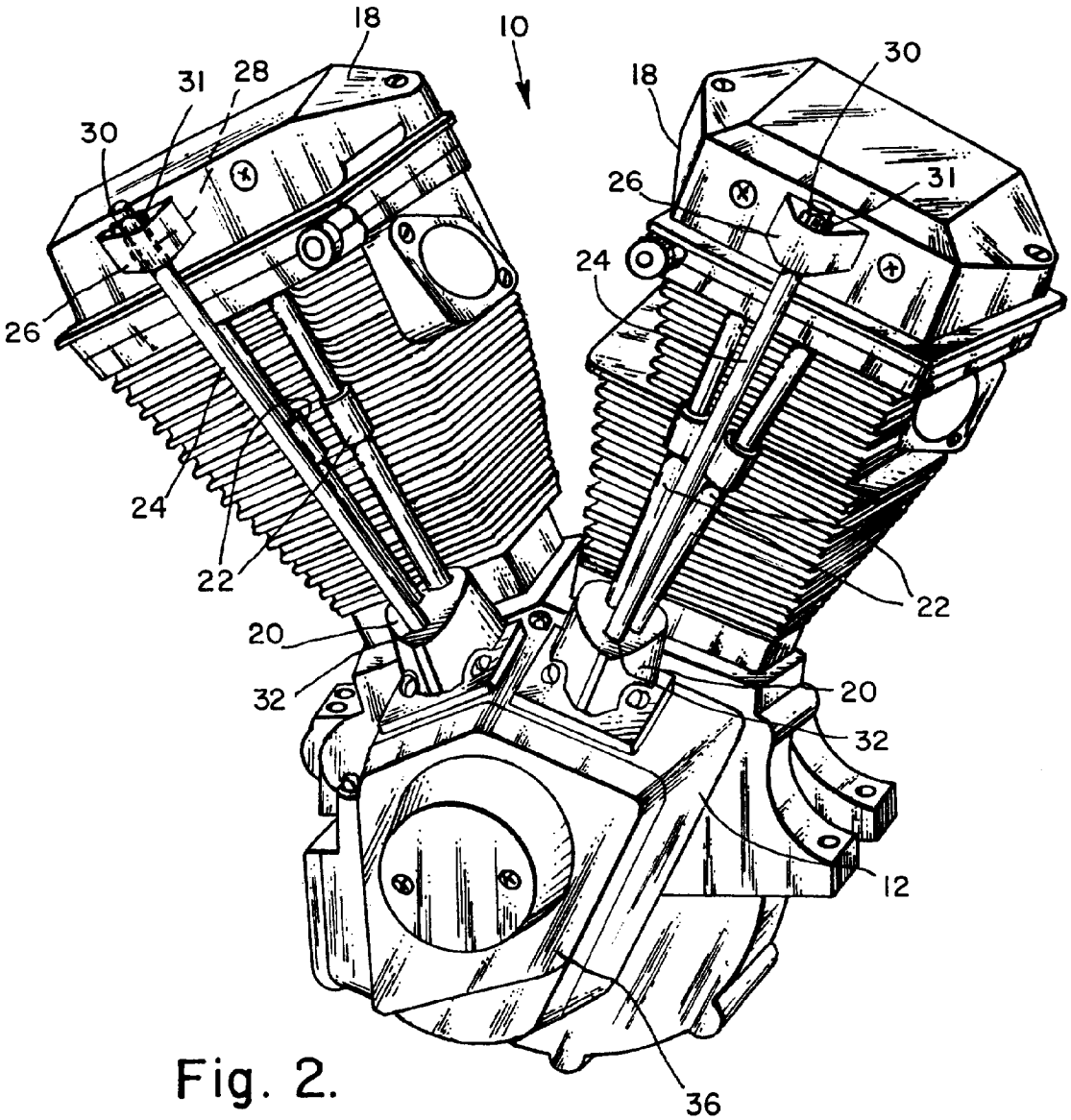
FIG. 2 is a perspective view of a first preferred embodiment of the present invention, specifically the brace of the present invention in combination with the engine of FIG. 1.

As shown in FIGS. 2 and 3, a first preferred embodiment of the engine brace according to the present invention includes as least one rigid elongate member 24 (e.g. a rod, stud or bolt) securing the rocker arm box 18 to the crankcase 12, outboard or outwardly of the pushrods extending through the pushrod tubes 22. A boss 26 is rigidly attached to and outwardly extends from the rocker arm box 18, on the pushrod (i.e. the pushrod tube 22) side of the secured cylinder 14/cylinder head 16 combination. The elongate member 24 may be a rod or stud, extending through an aperture or bore 28 in the boss 26, with the stud 24 having a threaded first or upper end 30 (as viewed in the drawing of FIGS. 2 and 3) with a nut 31 threadedly secured to the stud 24 and resting on the boss 26. A threaded second or lower end 32 (as viewed in the drawing) of the stud 24 is secured to the lifter block 20, such as by the stud's threaded lower end 32 threadedly engaging a threaded bore 34 in the lifter block 20 which is secured in conventional manner to the crankcase 12. The stud and nut may be replaced with a bolt having a headed upper end and a threaded lower end; and the nut 31 threaded onto the stud's upper end 30 may be considered as comprising a headed end 30, 31 of the stud 24. The boss 26 extends beyond the pushrod tubes 22 (and hence the enclosed pushrods) so that the stud 24 is positioned along the cylinder head 16 and cylinder 14, outboard or outwardly of the pushrods.

Figure 4:
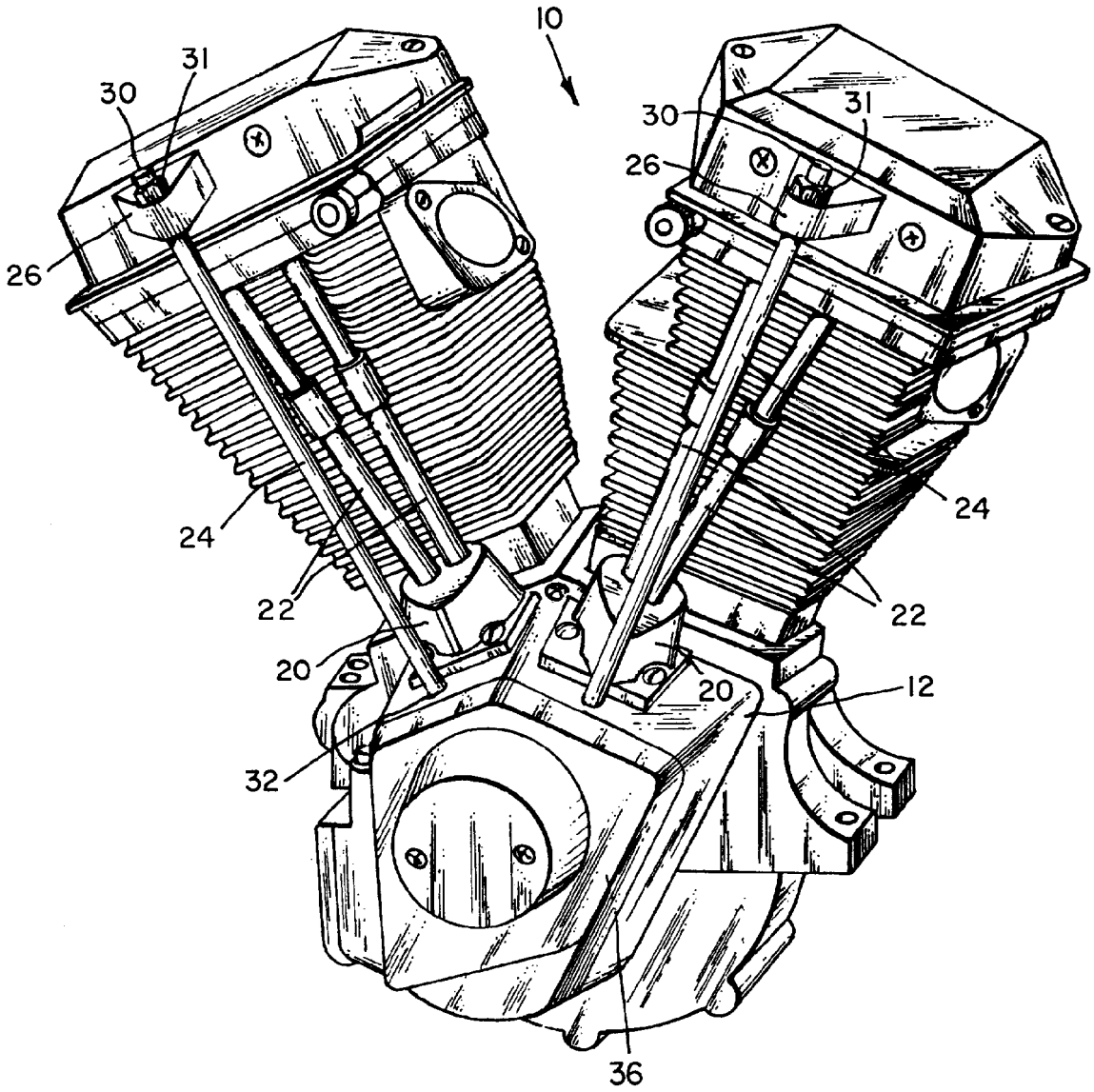
FIG. 4 is a perspective view of a second preferred embodiment of the present invention.
Figure 5:
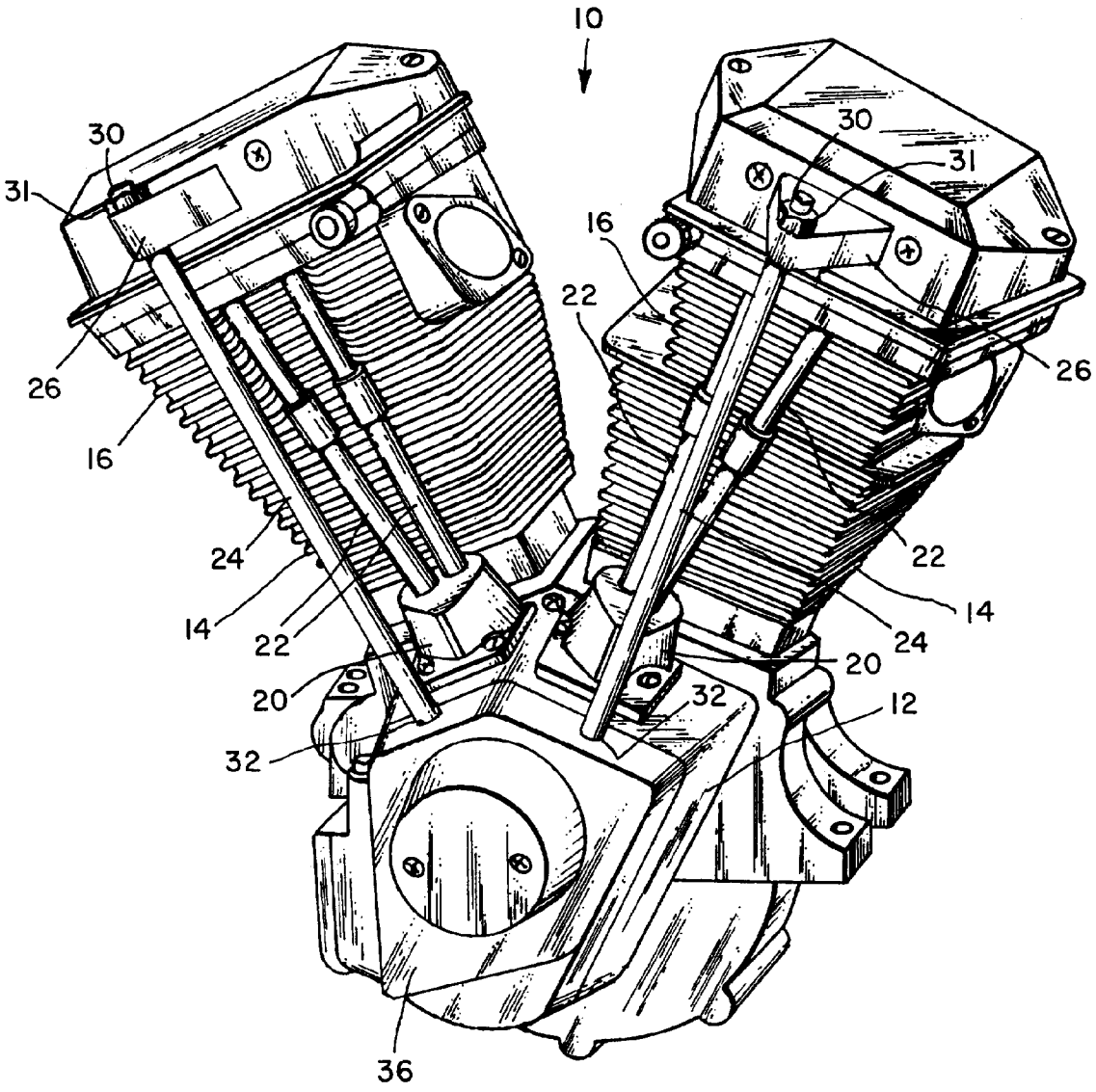
FIG. 5 is a perspective view of a third preferred embodiment of the present invention.

The embodiment of FIG. 4 shows the lower threaded end 32 of the stud 24 threadedly secured directly to the crankcase 12, and in the third preferred embodiment of FIG. 4 the threaded end 32 of the stud 24 is threadedly secured to the cam cover 36 which is operatively secured to the crankcase 12.

Attaching the upper end 30 of the rigid elongate member or stud 24 to the rocker arm box 18, outboard of the pushrods, resolves the stress at its source, relieving the conventional securing studs or bolts on the pushrod side of the rocker arm box of some of the stress imposed by the pushrods. Further, since the cam cover 36 contains the bearing that supports one end of a cam shaft, having the cam cover 36 receive the threaded end 32 of the stud 24 relieves the crankcase 12 of some of the valve trainimposed stress.

Thus there has been shown preferred embodiments of an engine brace for an overhead-valve engine, which adds rigidity to a conventional overhead-valve engine and structurally ties together the engine's rocker arm box, cylinder head, cylinder and crankcase, and prevents the engine's pushrods from lifting the rocker arm box. Other embodiments of the present invention, and other configurations of the embodiments shown herein, may be developed without departing from the essential characteristics thereof. Accordingly, the invention should be limited only by the scope of the claims listed below.

I claim:

1. In an overhead-valve engine, apparatus comprising in combination:

a crankcase, a cylinder, a cylinder head and a rocker arm box in operative securement;

pushrods communicating with said crankcase and said rocker arm box; and a rigid member securing said rocker arm box to said crankcase, the entirety of said member outwardly of said pushrods.

2. The apparatus according to claim 1, wherein:

said rigid member is elongate.

3. The apparatus according to claim 2, wherein one end of said member is secured to said rocker arm box and the other end of said member is secured to said crankcase.

4. The apparatus according to claim 2, further including a lifter block operatively secured to said crankcase, said pushrods extending between said lifter block and said rocker arm box, and wherein one end of said member is secured to said rocker arm box and the other end of said member is secured to said lifter block.

5. The apparatus according to claim 2, further including a cam cover secured to said crankcase, and wherein one end of said member is secured to said rocker arm box and the other end of said member is secured to said cam cover.

6. In an overhead-valve engine, apparatus comprising in combination:

a crankcase, a cylinder, a cylinder head and a rocker arm box in operative securement;

pushrods communicating between said crankcase and said rocker arm box;

a boss on said rocker arm box extending outwardly of said pushrods and including an aperture therein; and a rigid elongate member having a headed first end and a threaded second end, said member extending through said aperture in said boss with said headed end held by said boss and said member securing said rocker arm to said crankcase, the entirety of said member being outwardly of said pushrods.

7. The apparatus according to claim 6, wherein:

said threaded second end of said elongate member is threadedly secured to said crankcase.

8. The apparatus according to claim 6, further including a lifter block operatively secured to said crankcase, said pushrods extending between said lifter block and said rocker arm box, wherein said threaded second end of said elongate member is threadedly secured to said lifter block.

9. The apparatus according to claim 6, further including a cam cover secured to said crankcase, and wherein said threaded second end of said elongate member is threadedly secured to said cam cover.

* * * * *

UNITED STATES PATENT AND TRADEMARK OFFICE

CERTIFICATE OF CORRECTION

PATENT NO. : 6,152,097
DATED : November 28, 2000
INVENTOR(S) : Alan C. Sputhe

It is certified that error appears in the above-identified patent and that said Letters Patent is hereby corrected as shown below:

Title page,
In the "References Cited" section, the following U.S. patent documents should be added:

| | | |
|---|---|---|
| -- 4,836,158 | 6/1989 | Panzica |
| 5,072,697 | 12/1991 | Sputhe -- |

Column 3,
Line 51, "valve trainimposed" should be -- valve train-imposed --

Column 4,
Line 13, -- being -- should be inserted before "outwardly"

Signed and Sealed this

Eighteenth Day of September, 2001

*Attest:*

Nicholas P. Godici

NICHOLAS P. GODICI
*Acting Director of the United States Patent and Trademark Office*

*Attesting Officer*